US008544370B2

(12) United States Patent
Lamar

(10) Patent No.: US 8,544,370 B2
(45) Date of Patent: Oct. 1, 2013

(54) HANDLE-OPERATED TOOL WITH A MULTI-FUNCTION TOOL TIP EMPLOYABLE FOR ONE OR MORE PURPOSES ON DIFFERENT IRRIGATION-RELATED PRODUCTS

(76) Inventor: John Watley Lamar, Ojai, CA (US)

( * ) Notice: Subject to any disclaimer, the term of this patent is extended or adjusted under 35 U.S.C. 154(b) by 221 days.

(21) Appl. No.: 12/930,656

(22) Filed: Jan. 14, 2011

(65) Prior Publication Data

US 2011/0173760 A1 Jul. 21, 2011

Related U.S. Application Data

(60) Provisional application No. 61/336,175, filed on Jan. 19, 2010.

(51) Int. Cl.
*B25B 15/00* (2006.01)
*B25F 1/04* (2006.01)

(52) U.S. Cl.
USPC ..... 81/460; 81/461; 7/165

(58) Field of Classification Search
USPC ..... 81/436, 440, 451, 460, 461; 7/114, 7/170, 165; 29/266, 270, 271; D8/14, 86, D8/87, 105
See application file for complete search history.

(56) References Cited

U.S. PATENT DOCUMENTS

| | | | | | |
|---|---|---|---|---|---|
| 179,695 | A | * | 7/1876 | Frearson | 81/460 |
| 1,797,390 | A | * | 3/1931 | Wood | 81/436 |
| 2,140,449 | A | * | 12/1938 | Brown | 411/410 |
| 2,268,515 | A | * | 12/1941 | Olson | 81/460 |
| 3,658,105 | A | * | 4/1972 | Burt et al. | 81/460 |
| 3,985,170 | A | * | 10/1976 | Iskra | 81/438 |
| 4,325,153 | A | * | 4/1982 | Finnegan | 7/165 |
| 4,497,225 | A | * | 2/1985 | Vaughn | 81/451 |
| 5,023,989 | A | | 6/1991 | Hargrave | |
| 5,214,987 | A | * | 6/1993 | Fenton, Sr. | 81/460 |
| 5,347,893 | A | * | 9/1994 | Mikic et al. | 81/436 |
| 5,353,667 | A | * | 10/1994 | Wilner | 81/436 |
| 5,367,926 | A | * | 11/1994 | Mikic et al. | 81/436 |
| 5,421,225 | A | | 6/1995 | Chen | |
| 5,802,936 | A | | 9/1998 | Liu | |
| 5,904,080 | A | | 5/1999 | Anderson et al. | |
| 6,128,983 | A | * | 10/2000 | Arnn | 81/460 |
| D433,915 | S | * | 11/2000 | Elsener, Sr. | D8/105 |
| 6,352,010 | B1 | | 3/2002 | Giarrita et al. | |
| 6,494,121 | B1 | | 12/2002 | Hu | |
| 6,978,504 | B1 | | 12/2005 | Smith et al. | |
| 7,028,592 | B2 | * | 4/2006 | Hills | 81/436 |
| 8,047,102 | B2 | | 11/2011 | Gnatz | |

* cited by examiner

*Primary Examiner* — David B Thomas

(57) ABSTRACT

A tool incorporating a multi-function tool tip on an elongated shaft is disclosed for adjusting and maintaining different irrigation-related products of one or more manufacturers, having a handle configured at one shaft-end, and formed at an opposite shaft-end a multi-function tool-tip with a screw adjustment member located between two outwardly-extended generally planar members. In one tool function mode leading-edge portions of the planar members are sized and shaped to align and rotate within a conical recess of a first irrigation-related product and facilitate engagement of the screw adjustment member with an upper end of an adjustment screw centered within the conical recess. In other functional modes, the planar members are sized and shaped for insertion through an adjustment port of a spring-loaded slidably-positionable member of a second irrigation-related product to pull the member outward to a desired degree and/or make water emitting adjustments interiorly within the product.

21 Claims, 4 Drawing Sheets

HANDLE-OPERATED TOOL WITH A MULTI-FUNCTION TOOL TIP EMPLOYABLE FOR ONE OR MORE PURPOSES ON DIFFERENT IRRIGATION-RELATED PRODUCTS

CROSS REFERENCE TO RELATED APPLICATION

This application claims priority from U.S. Provisional Patent Application No. 61/336,175, entitled Single-Shaft Multi-Function Tool for Use with Various Irrigation-Related Products, filed Jan. 19, 2010 by John Watley Lamar, which application is incorporated by reference as if set forth herein in its entirety.

FIELD OF THE INVENTION

The present invention pertains to a handle-operated tool incorporating a multi-function tool tip on a tool shaft or an elongated tool shaft, the tool generally but not exclusively concerns, irrigation and water management matters, employable in the fields of environmental design, architectural landscaping, water conservation, landscaping, the maintenance of small, medium and large-scale or large acreage private and public properties, farming, gardening, and the like, and in the setting up and maintaining of commercial and residential irrigation-related products or systems, or both. More particularly, the present invention pertains to a tool incorporating a multi-function tool tip on or proximate to an end of a tool shaft, employable for different operations on various irrigation-related products, including linearly positioning and rotationally adjusting members and elements of a range of irrigation-related products made by competing manufacturers. For ease of reference the field of the present invention may hereinafter be referred to generally as one pertaining to 'irrigation-related' tools, wherein such term is intended to be inclusive of tools employable in any among the aforementioned fields.

BACKGROUND OF THE INVENTION

In recent years, an increased demand in water, especially in areas having dense, rapidly growing populations has brought the subject of water management and conservation to the forefront. Indeed, in certain drier climates, water has become, and is now viewed as a very valuable resource. Consequently, efforts are being made to avoid the wasting of water, and in finding better ways to conserve it and promote using it wisely. One of areas where water conservation has seen some improvement, and can make further improvements still, is in the field of irrigation. Changes even as simple as a more effective managing, maintaining and repairing of irrigation-related products and systems can have a significant impact on water conserving efforts.

For example, having the right tool for the job at hand can mean the difference between a well-maintain irrigation product or system, versus unattended/broken products, products that are poorly or improperly adjusted, products having one or more minor or major leaks, and so forth. A number of manufacturers of irrigation-related products, or systems, or both, are making strides in improved water-conserving and water-efficient products, however, a problem has arisen due to the diversity of these products that pertains to the field of tools used in their installation, maintenance and repair. Namely, that there is little to no standardization in the way that one manufacturer's products and systems are installed, maintained and/or adjusted compared with those made by one or more competing manufacturers. Consequently, as will be described in more detail in the description to follow, simply not having the right tool can result in the unnecessary wasting of an often limited water supply.

As irrigation-related and water management related products and systems have evolved over recent years, many of these products have become specialized to address irrigation and water management in more efficient, environmentally-friendly and cost-saving ways. For example, one area in which a number of manufacturers in this field have directed their attention is in the design and making of a variety of increasingly water-efficient and highly adjustable sprinklers or sprinkler head nozzles, and controllers of the same. Many of these products have the advantage of much more precisely directing a desired spray arc (or width) and water volume radius (or distance or span) during one or more predetermined periods of time. Nonetheless, as these products multiplied and became particularized by their respective manufacturers, some, either in part or entirely, required the use of one or more product-specific tools. For example, a tool made by one manufacturer adjusts only the radius or distance that their sprinkler head sprays water, and another manufacturer's tool is only employable adjusting the arc or width of a spray pattern of their sprinkler(s), and so forth. However, professionals in the field often need to install, set up, adjust, maintain and/or repair a variety of these products (potentially also including respective controllers, valves, associated tubing or plumbing, and the like) produced by a number of competing manufactures. A sampling of such manufacturers includes, but is not limited to, Hunter Industries®, RainBird®, Toro®/Irritrol®, K-Rain® and Weathermatic®. Accordingly, the need for professionals to carry a variety of specialized company or product-specific tools with them has considerably increased.

Thus, those working in the field, installing, setting up, adjusting, maintaining and/or repairing such products, systems, or both, have found themselves (a.) often not having the right tool for a given task, (b.) unable to adjust or maintain a product or system correctly, (c.) needing to carry one or more, or an assortment of, additional specialized tools or (d.) facing undesirable or unwanted consequences. For example, in the latter case, such outcomes may include emergency or critical situations, resulting in an expense of unnecessarily wasted water, or costly water damage, simply due to not having the required tool. Such undesirable results can be avoided however, by instead, having on hand, a versatile multi-function tool, or multi-tool incorporating the same, that has been specifically designed to work with products and/or systems made by a number of competing manufacturers.

Some efforts have been made in the field in an attempt to produce tools that could perform more than one function or adjustment, but such tools have mostly remained company-specific or highly product-specific, as a consequence of not being designed or intended for, or being well-suited to, working with one or more competing manufacturer's products. For example Hunter Industries® has provided a small, light-weight orange-colored tool, designed specifically for making adjustments to an adjustment ring and to an adjustment screw of the MP Rotator® series of sprinkler head nozzles. However, because this tool is product-specific, it is suited for being used with products made by different, competing or various, manufacturers. Elaborating on a situation previously described, one company might provide a product-specific tool wherein one tool tip or tool portion is suitable for adjusting a particular sprinkler head model's, or water nozzle model's, spray distance, while another tool tip or portion of the same tool is suitable for adjusting that model's spray width, albeit with the shortcoming that the tool is entirely unusable (or not well-suited to use) with a similar product type made by one or more competing manufacturers. Accordingly, there is a need to address such shortcomings, and it is among the objects of the present invention to provide a handle-operated tool incorporating a multi-function tool tip on tool shaft or an elongated tool shaft, employable for different operations on various irrigation-related products, or to provide a multi-tool handle incorporating the present tool and multi-function tool tip.

Another problem in the irrigation-related and water-managements fields is that is not uncommon for professionals to find themselves in cramped quarters or openings, or in places where it is not conducive to carrying of a number of tools, or the moving about of a large or cumbersome toolbox. For example, one can be working in a relatively small recessed area where it is difficult or very inconvenient to have to quickly set down one or more tools and rapidly pick up one or more other urgently needed tools. These, and other, environments can present additional challenges, for example when there is a significant water leak, or body of standing murky or running water where attempting to quickly set down and use multiple, separate tools can created added stress, or even exacerbate a critical situation when a needed tool cannot be found. Consequently it would be advantageous to provide an easy to carry a multi-function tool solely, or one incorporated into a multi-tool, wherein either is equipped to work with a number of competing manufacturer's products, associated products and/or systems, and it is among the objects of the present invention to provide such improved solutions.

Another area where portability and ease-of-use are important to professionals in the field is in the management and maintenance of medium to large-scale or large-acreage, private or public properties, for example, parks, campuses, golf courses, cemeteries, estates, and the like. In such environments any number of needs can quickly or spontaneously arise where having a compact multi-function tool, or multi-function/multi-tool, equipped to work with products or systems made by various competing companies can provide an ideal solution to one working in the field, for example, when one is some distance from a service truck or vehicle, tool shop, workshop or toolbox. To effectively address such needs, it is among the objects of the present invention to provide such compact, portable and easy-to-use multi-function tools and multi-function/multi-tools that are readily employable on competing products and systems.

A simplifying of installation and maintenance requirements can also be conducive to an increase in the sales of irrigation-related products and systems by various manufacturers. For example, when contractors, gardeners, handymen, or homeowners experience firsthand that many common irrigation-related and water management related tasks can be handled by a single compact, portable and easy-to-use multi-function tool or multi-function/multi-tool, operational complexities, as well as one's learning curve, are reduced. There is a saying, that "People enjoy doing what they're good at." This saying suggests that the simpler something is to do, learn, or gain confidence in, the more likely one is to enjoy it. Accordingly, a part-time, weekend or intermittent user of irrigation-related products or systems is likely to gain a greater sense of confidence in what he or she is installing, maintaining or servicing when, instead of having to learn and work with multiple product-specific, specialized tools, they can use a single easy-to-use tool compatible with a variety of water distribution devices, sprinklers, irrigation-related products and systems, and the like. These ease-of-use and cross-compatible aspects of the multi-function tools, and multi-function/multi-tools described herein, thereby empower users to use one or more brands of irrigation-related products and systems that they purchase, install and maintain. In discovering that such products and systems are easy to maintain, and in gaining some increased confidence along the way, users are more likely to purchase and use additional or related products; to increase the awareness of others through valuable word-of-mouth recommendations; all of which is helpful to various manufacturers (such as any one or more among those mentioned above) by increasing the sales of their irrigation-related products and systems.

Another factor influencing the decisions of potential customers of irrigation-related products, systems and tools is the impact that any of the same might have on the environment. Some tools, such as those previously described that are intended for use with a company-specific product or product-line, may be made of a combination of plastic and metal material but not made to be subsequently separated in a way that is ideal for recycling, or may be viewed as an inexpensive product meant to be (or that simply can be) disposed of after being used minimally. In contrast, multi-function tools of the present invention may optionally be made of metal and plastic parts and made pre-disposed with break-away or separable parts to facilitate easy recycling. With respect to the status quo small, mostly plastic tools, another problem is that they can also be easily lost due to their having a small size and weight (e.g., if it falls out of a pocket one might not even be aware that it is missing).

Another shortcoming of such small tools is that some are made with one or more tool ends that do not have a self-centering alignment means to assist in aligning an operative end of the tool within a very small screw head, socket, port, opening or odd-shaped aperture. Consequently, such tool ends may not align easily or properly, and certain users may feel it is a necessity to carry glasses or other magnification means with them in order to use such tools. Additionally, certain sprinkler head nozzles may be equipped with an adjustable screw that is very small (such as the MP Rotator® series) making it likely that one will not have on hand a small enough standard screwdriver to engage and make quick and accurate adjustments to one, or many, of such sprinkler heads. To address this problem a blade (e.g., 18) of the multi-function tool-tip 22 of the present invention is designed to optimally, quickly and accurately be used in the field to make easy adjustments to one or many of such small adjustable screws, in a manner requiring little or no visual aligning by a user. It is also noted that Hunter Industries' MP Rotator® products have been designed to match optimum precipitation-rates required by given soil types, and when properly adjusted, provide no more than a needed supply of water for a given environment. Accordingly, the MP Rotator® can be very efficient in conserving water, if properly adjusted and maintained. The multi-function tool-tip of the present invention is designed to facilitate the making of fine and optimal adjustments to the MP Rotator® series of sprinkler head nozzles and to other irrigation-related products as well.

In preferred embodiments of the present invention, a tool incorporating a multi-function tool tip on a tool shaft or an elongated tool shaft, employable for different operations on various irrigation-related products, or multi-tool handle incorporating the same, are each made of a durable, non-rusting metal material, for example, stainless tool steel, wherein each of the tool embodiments are designed to be employable with the products and/or systems sold by competing manufacturers, and provide a multi-function tool-tip having one or more self-centering alignment means requiring little or no visual alignment by a user. Accordingly, the present invention provides a substantial (e.g., having enough weight and size to be easily managed and located), versatile multi-function tool having a durable and sturdy design which, following a long life-cycle, is also readily recyclable.

SUMMARY OF THE INVENTION

To address the above-described deficiencies and shortcomings of the existing status quo approaches the present invention provides a handle-operated tool incorporating a multi-function tool tip tool on a tool shaft or an elongated tool shaft, or multi-tool handle incorporating the same, wherein, at or proximate to one or both shaft ends, and optionally along a portion of the shaft, one or more irrigation-related or water management related tools or multi-function tool-tips are provided that are employable with a plurality, or a number of competing manufacturer's products, associated products or systems. In certain embodiments the handle-operated tool incorporating a multi-function tool tip on a tool shaft or elongated tool shaft may optionally include, be integrally formed with, otherwise associated with, attached to, or releasably engagable with, any among a variety of tool handles or grips. For example, the tool shaft and multi-function tool tip may be made of a durable material, for example stainless tool steel, securable with, adjoining, otherwise associated with, or made releasably engagable into and out of a corresponding socket of, any among an assortment of tool handles employed, or associated with, straight-shafted tools. In another embodiment of the present invention the tool may incorporate one or more arced, curved, bent or otherwise formed portions, optionally providing one or more tool functions or multi-functions and/or one of such portions being configured into the form or shape of a easy-to-use handle or grip. In another embodiment a shaft of the multi-function tool whether straight, mostly straight, or incorporating one or more arced, curved, radiused, bent or otherwise formed portions, is made attachable with, or rotatably mounted on, or releasably engagable into and out of a corresponding socket of, a multi-tool handle. The term 'multi-tool' or 'multi-tool handle' as used herein refers to a tool handle having at one or both ends means for pivotally attaching or mounting each of a plurality of tools employable on irrigation-related or water management related products, including the present handle-operated tool incorporating a multi-function tool tip on a shaft, or on an elongated shaft configured at one end for pivotable mounting on the multi-tool.

The present invention may be made of one or more materials suitable for making water-resistant, durable and reliable tools that are employable as previously described and in the detailed description to follow. In one of the preferred embodiments, the invention is made entirely or principally of a rugged metal material resistant to water and rusting, for example, a stainless steel or stainless tool steel. In embodiments wherein the tool with a multi-function tool tip is attached with, associated with, integrally formed with, made adjoining, is releasably engagable with, or rotatably mountable on, a handle or multi-tool handle, such handles may be made of the same material as the tool with the multi-function tool tip. Alternatively, the present tool with the multi-function tool tip and/or any handles associated with the tool may be made entirely or partially of any material suitable for making a durable, water-resistant, long-lasting product, for example, rugged or resilient material selectable from a group consisting of one or more of the following: metals, alloys, metal composite(s), plastics composite(s), plastic, fiberglass, carbon fiber, wood, plywood, wood fiber or composite, and the like. In each case, preferred embodiments of the present invention are made of, or comprise, one or more materials that can readily be recycled, re-used and/or re-purposed.

Some important aspects of the present tool and multi-function tool tip, or the multi-tool handle incorporating the same, warrant a more detailed review. Firstly, that at least one end of a multi-function tool of the present invention is equipped with a multi-function tool-tip employable in the adjusting of rotationally adjustable members or elements including spray radius or distance adjustment screws and linearly-positionable members or elements of a plurality of irrigation-related products or product-lines made by competing manufacturers. Secondly, preferred embodiments of the multi-function tool-tip include multiple tool-alignment contours which facilitate a self-aligning of the multi-function tool-tip in a plurality of axes during very different operations. For example, when the multi-function tool is employed operationally in its longitudinal axis, a first pair of curved contours on a leading edge of the multi-function tool-tip facilitates a quick aligning of the tool with an exterior interface portion of an adjustment keyhole or port having a shape which readily accepts the curved contours and then accommodates an insertion of the largest cross-section of the multi-function tool. Conversely, a second pair of curved contours (facing in the opposite direction of the leading edge curved contour pair) facilitates a quick aligning of the multi-function tool with an interior interface portion of the adjustment keyhole which readily accepts the latter curved contours when the tool needs to be removed from the keyhole or port. In a rotational adjustment operation provided by the multi-function tool-tip (prior to the just-described tool removal operation) the first and second pair of alignment facilitating curved contours, located on opposites sides of the tool-tip's transverse quick inserting, disengaging and alignment member, collectively provide rotational adjustments (about the tool's longitudinal axis) to an adjustable member or element interiorly located within a sprinkler head. In a very different rotational adjustment operation provided by the same multi-function tool-tip, just prior to the tool being employed rotationally (about its longitudinal axis), a pair of transverse or lateral alignment facilitating channels, each working in concert with and adjacent to a different one of the aforementioned pair of leading edge curved contours, collectively provide a quick dual-axes aligning of a water-spray adjusting blade of the multi-function tool-tip within a slot of a water-spray adjustment screw, that is part of, and is recessed within, a sprinkler head nozzle. It is further noted that each of the previously described alignment-facilitating aspects of the multi-function tool-tip may be performed in a manner requiring little or no visual aligning by a user, for example wherein much of the one or more aligning operations can be felt by the user through tactile feedback provided by one or more of the tool-tip's contour pairs, or channel pairs, or both, coming into contact with corresponding portions of an irrigation-related product, including those made by competing manufacturers.

The multi-function tool of the present invention, or any contiguous or separate portion or part thereof, may be made using any one or more among a variety of common or well-known manufacturing and/or finishing techniques, including, but not limited to: machining, milling, CNC machining or milling, stamping, injection-molding, vacuum-molding, pressure-molding or forming, die-cutting, laser cutting, high-pressure water cutting, extruding, forming, bending, pressing, fabricating, assembling, laminating, joining, broaching, grinding, drilling, lathing, tapping, threading, electrical discharge machining ('EDM'), burnishing, finishing, polishing, knurling, texturing, embossing, coating, sealing, protectiveseal coating, powder-coating, plating, dipping, painting, printing, imprinting, silk-screening, and the like. Additionally the present invention provides the option to include viewable content on one or more surfaces of a multi-function tool, or a handle or grip thereof or incorporating the same, such as: advertising, marketing, branding, instructional, promotional, cross-promotional, endorsement, graphical, photographical, a company name, company information, a logo, one or more URLs or web site addresses, a trademarked name and/or logo, a title, patent-related information, and the like.

The foregoing has outlined rather broadly features and advantages of the present invention so that those skilled in the art may better understand the detailed description of the invention that follows. Additional features and advantages of the invention will be described hereinafter adding to a basis on which subsequent claims of the invention can be made. Those skilled in the art should appreciate that they may readily use the conception and the specific embodiments disclosed as a basis for modifying or designing other multi-function tool-tips for carrying out the same purposes of the present invention, while also being aware that such equivalent constructions do not depart from the spirit and scope of the invention in its broadest form.

BRIEF DESCRIPTION OF THE DRAWINGS

FIGS. 1A, 1B, 1C, 1D, 1E, 1F, 1G, 1H, 1I, 1L 1J and 1K are two-dimensional side views depicting detail of a multi-function tool-tip of the present invention shown located at a lower end of a tool shaft or an elongated tool shaft. FIGS. 1A, 1C, 1D, 1E and 1G depict side views of an integrally formed or releasably retainable screw adjustment member consisting of a flat blade screwdriver-like tip located between two generally planar members each extending outwardly from a lower shaft-end. FIGS. 1I, 1J and 1K each depict the option of locating a different type of integrally formed or releasably retainable screw adjustment member between two generally planar members, namely, an Allen key-like or hex tool tip in FIG. 1I, a Phillips screwdriver tip in FIG. 1J and a Torx® tip in FIG. 1K.

FIGS. 1B, 1F and 1H depict side views of the multi-function tool-tips depicted in FIGS. 1A, 1E and 1G respectively with the tool shaft rotated 90° about its longitudinal axis. FIG. 1C illustrates an alignment of the multi-function tool-tip above a sprinkler head prior to it being lowered into a self-aligning orientation depicted in FIG. 1D (dashed lines indicated vertical alignment paths). The sprinkler heads illustrated in FIGS. 1C, 1D, 1E and 1F are shown in a partial cut-away view.

In FIG. 2A a positioning of a multi-function tool-tip is depicted aligned above a sprinkler head aperture prior to it being inserted downward into the aperture in accordance with another of the tool-tip's quick alignment functions. FIG. 2B illustrates the tool shaft being rotated so as to provide a lifting of a sprinkler pop-up portion as shown in FIG. 2C.

In FIG. 3 the tool-shaft incorporates an arced portion having a plurality of ridges configured to positively engage with grooves of an adjustment ring of a sprinkler head nozzle (shown in top view) to make rotational adjustments to the ring.

FIGS. 4 and 5 depict a tool-shaft handle integrally formed with an upper end of a tool-shaft. Optionally either or both handles may be equipped with an arced portion having a plurality, or one or more non-contiguous pluralities, of ridges for engaging corresponding ridges of a sprinkler head adjustment ring. In FIG. 4 an upper end of the tool-shaft is shown including an optional tool-tip socket and releasably engagable tool-tip. In FIG. 5 the tool-shaft incorporates a looped portion which can easily be retained to and released from attachment means for example a clip, looped material, tie, and the like.

In FIG. 6A the tool shaft and multi-function tool-tip are shown extending outwardly from the right-most end of the multi-tool. In FIG. 6B the tool shaft and respective multi-function tool-tip, and the assortment of other tools, are shown folded inwardly within the handle of the multi-tool.

DETAILED DESCRIPTION

Figures 1A, 1B, 1C, 1D, 1E, 1F, 1G, 1H, 1I, 1J, 1K:
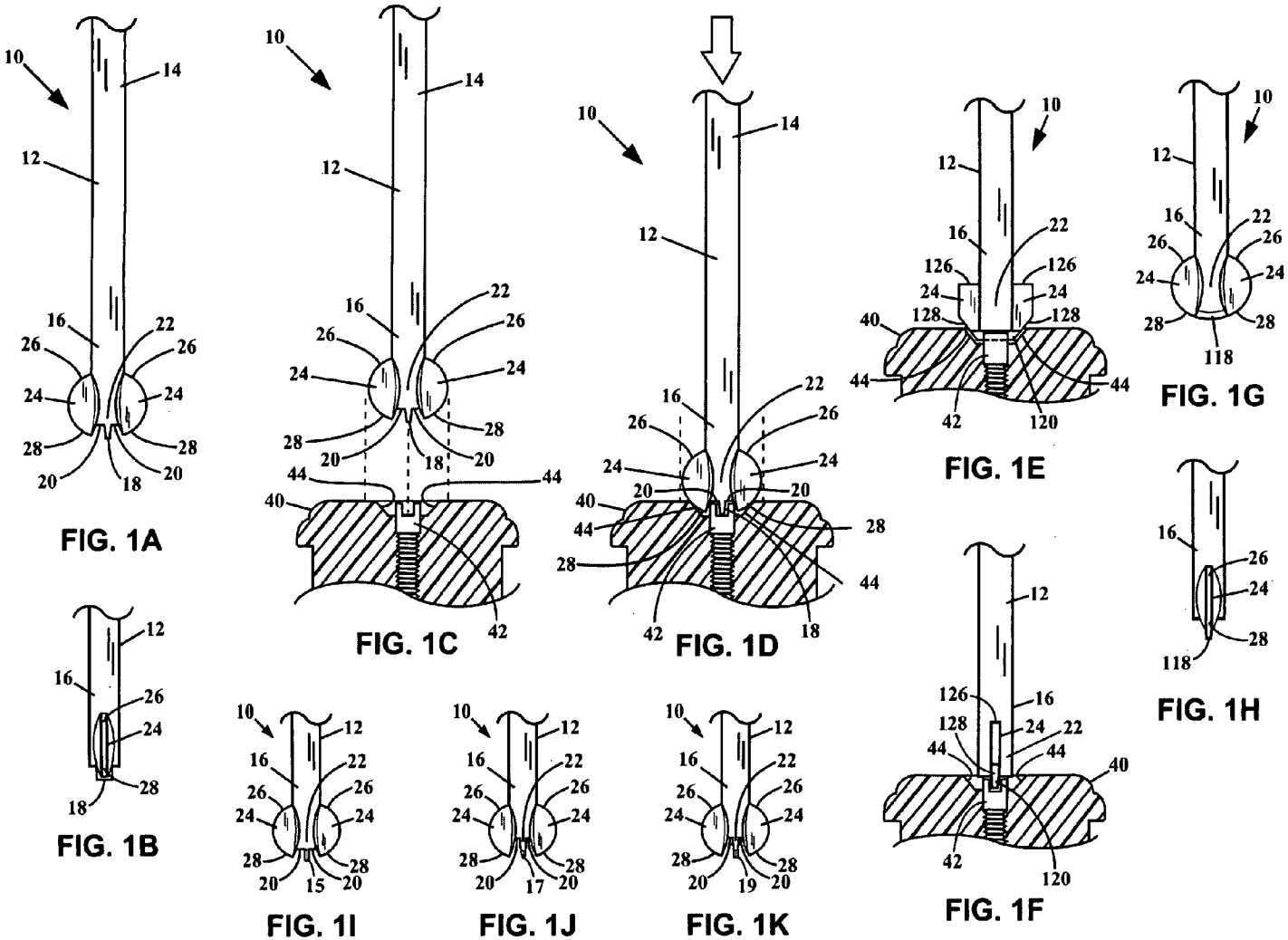

FIGS. 1A through 6D, discussed below, and the various embodiments used to describe the principles of the present invention in this patent document are by way of illustration only and do not limit the scope of the invention. Those skilled in the art will understand that the principles of the present invention may be implemented in many different suitably arranged multi-function tool-tips.

Reference numerals employed in the detail description to follow may be repeated in the drawings to assist, through a repeating, in a better understanding of the structure and/or operation of the present invention.

Turning initially to FIGS. 1A, 1B, 1C and 1D, a partial side view of a multi-function tool 10 incorporating a multi-function tool tip 22 on a tool shaft or an elongated shaft is illustrated having a tool-shaft 12, a shaft upper end 14, and adjacent to a shaft lower end 16 a multi-function tool-tip 22 employable in the adjusting of adjustable members or elements of a plurality of different types of irrigation-related products. The multi-function tool 10 may be made having any among a variety of tool-shaft cross-sections, for example, selectable from among a group of cross-sectional shapes consisting of: cylindrical, oval, elliptical, polygonal, or multi-sided cross-sections (e.g., hexagonal). In an exemplary embodiment the multi-function tool-tip 22 a small flat blade screwdriver-like tip having a water-spray adjustment blade 18 is located between two outwardly-extended generally planar members 24 each having a leading-edge contour 28 and a trailing-edge contour 26 which facilitate a self-aligning of the multi-function tool-tip in two to three axes during different operations. It is noted that the multi-function tool-tip 22 may alternatively be configured with a screw adjustment member or tool tip other than the flat blade screwdriver-like tip, for example, a Phillips, Torx®, Allen, hex key, or the like, integrally formed with the end of the shaft, or insertable as an exchangeable tool-tip into a socket or aperture formed in the end of the shaft. While the generally planar members 24 are described as "planar" it is noted that a single planar member or a pair of planar members can be made having any in a variety of different thicknesses while still having generally flat sides or surfaces. For example, in FIGS. 1B, 1F and 1H it can be seen that a planar member 24 having a given thickness (with generally planar opposite sides) can alternatively be configured with a single or a pair of thicker or thinner planar members, subject to the material from which the member(s) are made having sufficient strength for the purposes of the multi-function tool-tip 22.

Returning to FIGS. 1C and 1D, in operation a pair of curved or radiuses leading-edge contours 28 located at a lower end portion of multi-function tool-tip 22 are shown being brought into contact with a conical recessed surface 44 of a sprinkler head nozzle 40 (both shown in cross-section) as the multi-function tool is lowered downward from the position shown in FIG. 1C into the position shown in FIG. 1D (vertical dashed lines are provided to approximate an alignment path). As conical recessed surface 44 is cone shaped, it can be seen that the further the curved leading-edge contours 28 move downward (e.g., in a Z-axis) into the conical recess the more a dual-axes (e.g., X-axis and Y-axis) alignment will concurrently be facilitated, causing a centering of the water-spray adjustment blade 18 within a respective slot of a spray adjustment screw 42 such that the latter may then be adjusted as desired by a user rotating the multi-function tool. In certain respects the multi-function tool-tip 22 may be viewed as a type of T-member multi-functional tool equipped with a self-aligning screwdriver-like blade (FIGS. 1A through 1D), or alternatively a transverse blade (FIGS. 1E through 1H) formed at the lower end of the multi-function tool.

An additional tool self-aligning function of the multi-function tool-tip may also facilitated when moved downward from the position shown in FIG. 1C to the position shown in FIG. 1D (e.g., in the same or a similar operation). Wherein the additional self-aligning functionality is provided by a pair of screw-head alignment channels 20 also located at a lower end portion of multi-function tool-tip 22, which in combination with a contour defined by a cross-sectional portion of water-spray adjustment blade 18 can be seen to form a type of "M" shaped profile or contour which when brought into proximity with a spray adjustment screw 42 is conducive to further increases in alignment. For example in FIG. 1D the pair of screw-head alignment channels 20 are each depicted preferably having one or more canted or angled edge-contours so that the opening of each channel 20 nearest to leading-edge 28 of a planar member 24, or nearest the end of the tool-tip, is wider than the trailing-edge of the channel. Accordingly can be seen straddling a cross-sectional contour of an upper portion of water spray adjustment screw 42. It is noted that a pair of screw-head alignment channels 20 when transversely formed (or mounted) adjacent or proximate to a water-spray adjustment blade 18 at the lower end of a multi-function tool-tip 22 will optimally interface with and provide the aforementioned self-aligning aspects with a product-line of sprinkler head nozzles such as the MP Rotator® series made by Hunter Industries®. Additionally or alternatively it can be advantageous to make certain embodiments of a multi-function tool such that a water-spray adjustment blade 18 extends outwardly somewhat farther than one or both of the radiused or curved leading edge contours 28. It may also be advantageous to provide a multi-function tool-tip embodiment having a single generally planar members (not illustrated), wherein the tool has a somewhat skeleton key like appearance and may optionally include a small tip portion opposite from the single planar member sufficient in size and shape to contact the conical recess surface 44 in a manner similar to that of a leading-edge contour 28 of a second generally planar member 24. When either an extended length water-spray adjustment blade embodiment and/or a single planar member equipped tool-tip embodiment proves advantageous, the present invention provides the option to make and provide either or both of such embodiments.

Figure 2C:
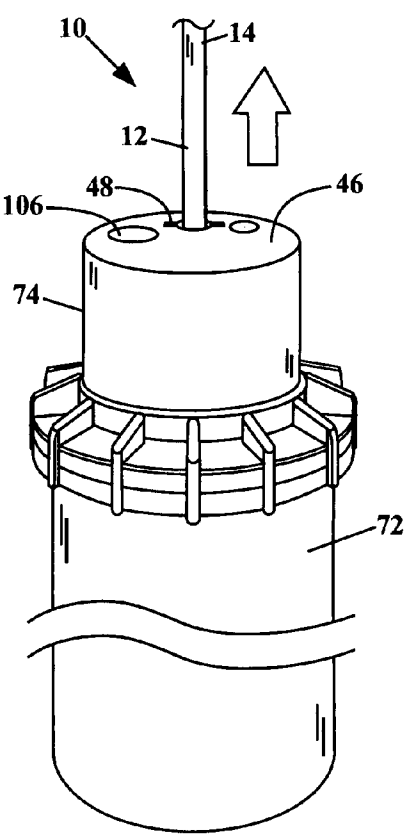
FIGS. 2A, 2B and 2C are three-dimensional side views depicting a function of a multi-function tool-tip of the present invention different than that of FIGS. 1A, 1B and 1C.
Figure 2B:
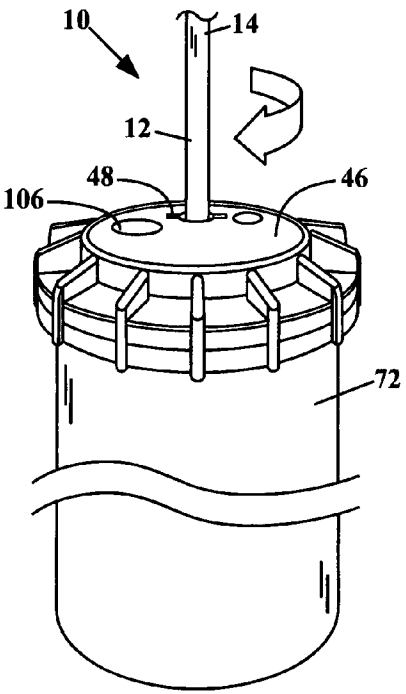
Figure 2A:
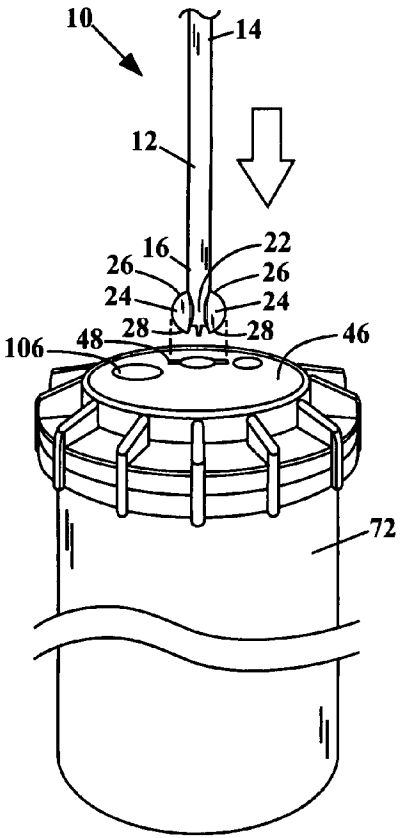

It is also noted that minor modifications can be made to one or more portions of a multi-function tool-tip 22 to provide similar functionalities and structure without departing from the spirit of the invention, such as the embodiments of the tool-tip depicted in FIGS. 1D and 1E. Whereas a water-spray adjustment blade 18 and adjacent screw-head alignment channels 20 of the multi-function tool-tip 22 were shown being configured to form the previously described "M" shaped contour, with the blade depicted in FIGS. 1A through 1D in a transverse orientation, perpendicular to the pair of curved leading edge contours 28, alternative blade configurations can otherwise be made and provided. In a first minor modification example, the blade of a multi-function tool-tip formed transversely at a lower end of the tool-tip may otherwise be rotated in any number of degrees of rotation selectable from among 0-180° range, or not in alignment (e.g., instead of the previously-described perpendicular or 90° rotation relative to a single or a pair of generally planar members 24 (depicted in FIGS. 1A through 1D). Additionally or alternatively the multi-function tool-tip can be made without screw-head alignment channels 20. Some other examples illustrating minor modifications to a blade shape and tool-tip contours are shown in the embodiments depicted in FIGS. 1E and 1F, and FIGS. 1G and 1H, wherein a water-spray adjustment blade is shown being formed, located or otherwise configured in general alignment with the same plane as the pair of curved leading edge contours 28. For example, a water-spray adjustment blade 118 shown optionally having a slight arced leading edge contour in FIGS. 1G and 1H, and the water-spray adjustment blade 120 shown having a straight leading edge in FIGS. 1E and 1F, may extend transversely entirely, or partially, between a pair of radiused, curved or angled leading-edge contours such that a lower portion of the blade will be easily alignable within a slot of a spray adjustment screw 42 (to make rotational adjustments to the screw). FIGS. 1E and 1F further depict an upper portion of a sprinkler head nozzle 40, a spray adjustment screw 42 rotated 90° relative to the screw depicted in FIGS. 1C and 1D, and a dashed 'ghost' line in FIG. 1E representing the straight leading edge of water-spray adjustment 120 as seen through the screw head (with the blade engaged into the slot of the screw). It is further noted that in the embodiments depicted in FIGS. 1E and 1F, and FIGS. 1G and 1H the water-spray adjustment blades (120 and 118 respectively) still benefit from the previously described multi-axes self-aligning function whether such aligning is provided by the pair of curved leading-edge contours 28 (shown in FIGS. 1G and 1H) or the pair of angular leading edge contours 128 (shown in FIGS. 1E and 1F) as either contour type interacts or interfaces with conical recessed surface 44. It is also noted that one or both pairs of the previously described curved contours can instead be configured with an angular contour, for example either or both contour pairs (26 or 28) may incorporate an angle such as angular contour 126 or angular contour 128 of FIG. 1E. In each case, a single, or pair of trailing-edge contours 26 or contoured pair 126, (i.e., whether made curved or angular) are insertable within and removable from a sprinkler head adjustment port opening, such as a socket or lifting port 48 shown in FIGS. 2A, 2B and 2C (e.g., generally round in shape and incorporating a slotted portion) and following insertion and some rotation of the tool-tip (e.g. optimally around 90°) serve as a means for lifting a sprinkler pop-up member 74 as depicted in FIGS. 2A, 2B and 2C. Additionally, the rotational adjustment function of the generally planar members 24 (e.g., as depicted in FIGS. 2A, 2B and 2C) operates similarly whether incorporating the aforementioned curved contours, angular contours, or any combination thereof. It is noted that a multi-function tool-tip whether having a single generally planar member 24 or two generally planar members 24 is sized and shaped to also be insertable into a water-arc adjusting port 106 (depicted in FIGS. 2A, 2B and 2C) and to make interiorly within a sprinkler pop-up member 74 or the like, water emitting or water arc emitting adjustments.

It is further noted that any of the aforementioned water-spray adjustment blade types may separately be made of a suitable metal material e.g., having water-resistant properties and/or surface coating, or made of stainless steel, and alternatively may have a multi-function tool made of a suitable durable plastic material, wherein the latter is equipped or configured to positively retain a first water-spray adjustment blade portion having an extended leading-edge portion which is exposed to operate in a blade-like manner previously described.

Preferably the multi-function tool 10 and multi-function tool-tip 22 and its respective elements are made of the same durable rust and water resistant material, such as stainless tool steel. Alternatively, multi-function tool 10 and its multi-function tool-tip 22 can be made of a durable plastic material, or any combination of metal and plastic material suitable for making a long-lasting, water and rust resistant tool, such as material(s) that can readily be recycled, re-used and/or re-purposed.

In further reference to FIGS. 2A, 2B and 2C it is noted, that instead of the generally planar members 24 having redundant opposing members (e.g., each with their respective elements 24, 26 and 28, or 24, 126 and 128), that in some cases it may be advantageous to make one or more multi-function tools 10 with a key-like appearance primarily having only one of the members, in which case the multi-function tool will still retain much of the aforementioned functionalities. For example it can be seen that if the multi-function tool 10 of FIG. 2A has one generally planar member or two, that it will readily be accepted when inserted into lifting port 48, e.g., when positioned longitudinally as indicated by the parallel dashed lines and downward pointing arrow in FIG. 2A, and after being rotated by a user as indicated by the sideways pointing arrow in FIG. 2B (e.g., 90° or out of aligning with the slot portion of the opening) one generally planar member or two and their upper trailing-edge contour(s) 26 may then be employed as a single or double lifting member (respectively) to position or lift a sprinkler pop-up member 74 to a desired degree in a direction opposite of the insertion direction such as that indicated by the upward pointing arrow shown in FIG. 2C. Subsequent to any of the steps depicted in FIGS. 2A through 2C, a single or double generally planar member equipped multi-function tool can readily be removed from the lifting port 48 by rotating the member(s) into alignment with the slotted portion of the opening and extracting the tool.

In a different operation, a multi-function tool 10 having a single generally planar member (e.g., with a key-like appearance), or having two generally planar members as depicted in FIG. 2A, may be employed to make rotational adjustments to rotational adjustment members or elements of one or more irrigation-related products e.g., made by different manufacturers. For example a portion of a sprinkler, such as sprinkler upper end 46 equipped with a generally round port 106 such as a spray-arc adjustment port providing access to an interiorly located rotational adjustment member or element made to interface with and accept adjustments made by a user employing a multi-function tool having two generally planar members (or the like) may also respond similarly, or just as well, to adjustments made by a user of the multi-function tool-tip having a single generally planar member 24. When the latter is the case the present invention provides the option to make and provide such multi-tool embodiments.

Figure 5:
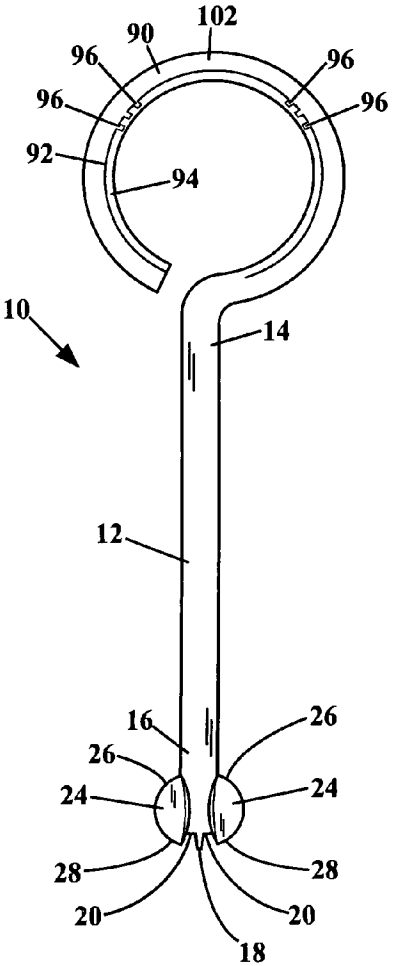
FIGS. 3, 4 and 5 are two-dimensional side views depicting detail of a multi-function tool-tip of the present invention each shown located at a lower end of a different-shaped tool shaft.
Figure 4:
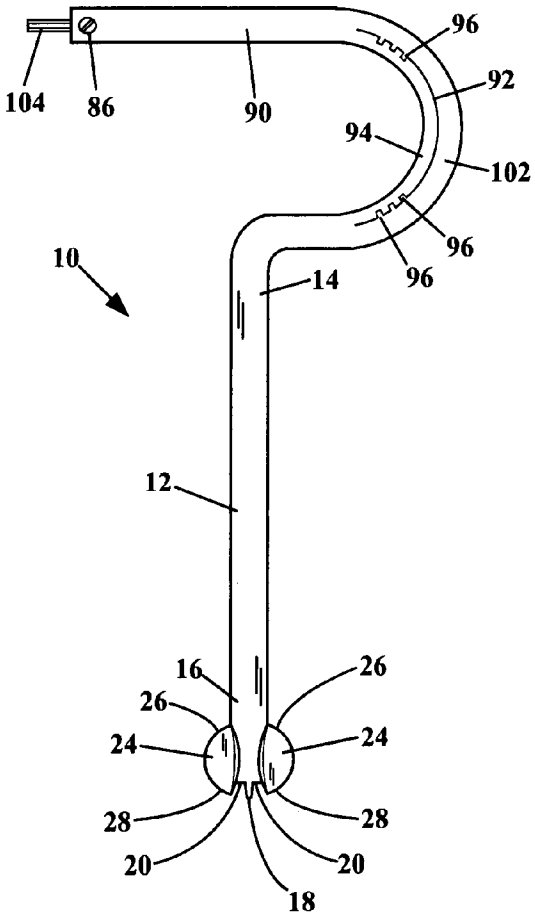
Figure 3:
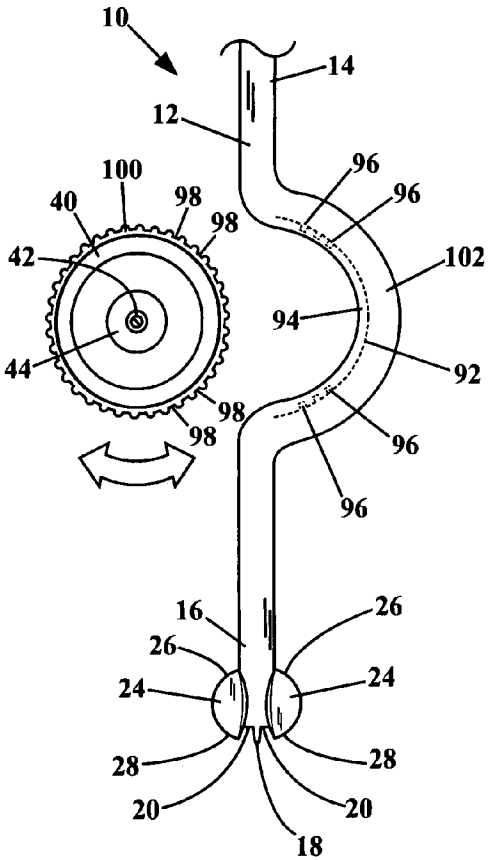

In reference to FIGS. 3, 4 and 5, each multi-function tool 10 is shown incorporating an optional arced shaft portion 102 having means for engaging an adjustment ring 100 of a sprinkler head nozzle 40, for example, a plurality, or one or more non-contiguous pluralities, of teeth 96 or ridges. In FIG. 3 teeth 96 are shown in a dashed 'ghost' line representing the elements as if seen through to the underside of the arced shaft portion 102. Preferably arced shaft portion 102 is equipped with a recessed arced-portion 94 having an arced contoured surface designed to interface with at least a perimeter portion of an adjustment ring 100 of a sprinkler head nozzle 40 (shown in top view), for example, configured to positively engage teeth 96 within grooves 98 of the adjustment ring to make clockwise and/or counter-clockwise rotational adjustments to the ring (e.g., as indicated by the double-headed arrow seen beneath the nozzle 40). The plurality of teeth 96 may be formed by a conventional manufacturing process or be manufactured by one or more of the processes previously described, such that they readily engage with and release from the grooves 98 as needed.

In FIGS. 4 and 5 an upper portion of the multi-function tool shaft includes an arced shaft portion 102 configured into a tool handle 90 (or grip) wherein in FIG. 5 the handle is shown having a loop or hook shape. In FIG. 4 the handle is depicted ending with a straight shaft and may optionally be configured with a cylindrical or multi-sided socket configured for engaging any one or more among a variety of a releasably retainable tool-tip(s) 104, for example, wherein each tool-tip has a respective, matching cylindrical or multi-sided shaft. When a handle end incorporates a cylindrical or multi-sided socket, either may be fitted with an internal tool-tip clipping or retaining means (e.g., a socket ball-in-groove type), or an externally accessible tool-tip retaining means 86 for example a set screw. It is noted that embodiments of the present invention having a multi-function tool equipped with a handle-end or shaft-end incorporating a cylindrical or multi-sided socket, may additionally be equipped with an attachable receptacle, enclosure, bag, pocket, pouch, or one or more clips or retainers, for retaining one or more releasably retainable tool-tip(s) 104 (e.g., a variety of different tool-tips), and any of such retaining means may optionally be made attachable to or adjoining, releasably retainable on, incorporated into, or otherwise associated with a portion of the multi-function tool or a handle thereof. Alternatively, a receptacle, enclosure, bag, pocket, pouch, or one or more clips or retainers, or tool-tip organizer, for retaining one or more releasably retainable tool-tip(s) 104, may be sold as a separate accessory associated with a multi-function tool configured to employ releasably retainable tool-tips.

It is noted that the examples depicted in FIGS. 3, 4 and 5 are illustrative, and that many other types of handles and tool shaft shapes or forms and shaft endings are also possible and may be used. For example, above an upper shaft portion 14 of tool-shaft 12 of FIG. 5, a portion of the shaft may otherwise be formed into a figure-eight shape, resulting in a double-hoop shape, including the option to configure the double hoop in a perpendicular orientation to the tool shaft as an easy to grasp handle. Or as previously mentioned, a multi-function tool 10 of the present invention may be: fitted with, integrally formed with, rotationally mounted to, attached to, incorporated with, associated with, or made releasably engagable with, any one or more among a variety of handles, for example, a tool handle incorporating ratcheting means, or handles selectable from those employed on typical single-shaft tools.

In another embodiment a socket or opening sized and shaped to receive and releasably retain any of the aforementioned exchangeable tool-tips may alternatively or additionally be located at an opposite end of the shaft of the multi-function tool shown in FIG. 4, wherein the socket or opening is configured to retain any one of the exchangeable tool-tips, including a transverse blade 118 or screwdriver-like blade 18 mounted to an exchangeable tool-tip shaft sized and shaped to fit in the socket or opening (not illustrated). Thus, a multi-function tool-tip end may be configured or equipped with an exchangeable transverse blade 118 or screwdriver-like blade 18 or other alternative rotational adjustment member such as a hex key, Allen key, Torx®, or Phillips screwdriver, and the like.

Figure 6A:
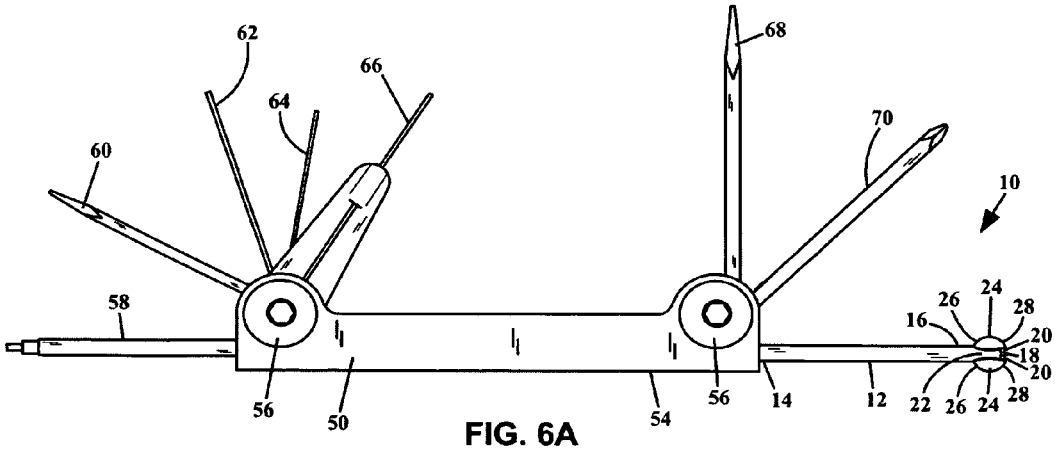
FIGS. 6A and 6B are two-dimensional side views depicting detail of a multi-function tool-tip of the present invention located at the end of a tool shaft or an elongated tool shaft rotationally mounted to an irrigation-related multi-tool comprising an assortment of tools employable in one or more irrigation-related fields.
Figure 6B:
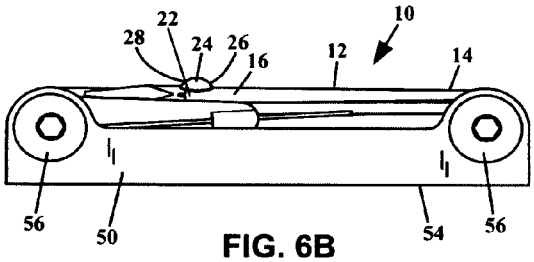

In another advantageous embodiment of the present invention, depicted in FIGS. 6A through 6D, a multi-function tool 10 is associated with a handle configured for being rotationally mounted on and incorporated with a multi-tool handle 54 of a multi-tool 50 specialized for working with a variety of irrigation-related products and/or systems. In FIG. 6A a multi-function tool-tip 22 is shown located at an outward-most end of tool-shaft 12. The opposite end of the tool-shaft is configured into a generally closed loop, or is otherwise equipped with or incorporates a mounting aperture, for pivot mounting, and selective pivotal positioning of tool-shaft 12 about fastening means 56, such as a round-head hex bolt mounted transversely through the generally closed-loop or mounting aperture, positively retained by a nut and washer, or nut 88 (the latter shown in FIG. 6D). For example it can be seen that all tools pivotably mounted at opposite ends of multi-tool 50 as depicted in FIG. 6A, are pivotably positionable and shown having been rotated more than 40° outwardly from the multi-tool handle 54. In FIG. 6B it can be seen that all tools, including multi-function tool-tip 22 shown on an outward-most end of tool-shaft 12, have been pivotably positioned inwardly into the multi-tool handle 54. Preferably tool-tip 22 is configured such that one or both generally planar members 24 will, when pivoted to a fully closed position as shown in FIG. 6B, be aligned with one or more adjacent tools pivoted to a fully closed position, such that the tool-tip is entirely retained within the multi-tool handle or nearly fully retained therein. Alternatively, tool-tip 22 may be located at an end of shaft 12 equipped with a single generally planar member 24, or two generally planar members 24 rotated 90° about the shaft 22 (relative to FIGS. 6A, 6B and 6C) and thereby orientated to lie or seat flat on any adjacent one or more tools pivoted to a fully closed position within the multi-tool handle when the combination of shaft 12 and its tool-tip are also pivoted to a fully closed position, such that the flat lying tool-tip is fully retained within the multi-tool handle or nearly fully retained therein.

Figure 6C:
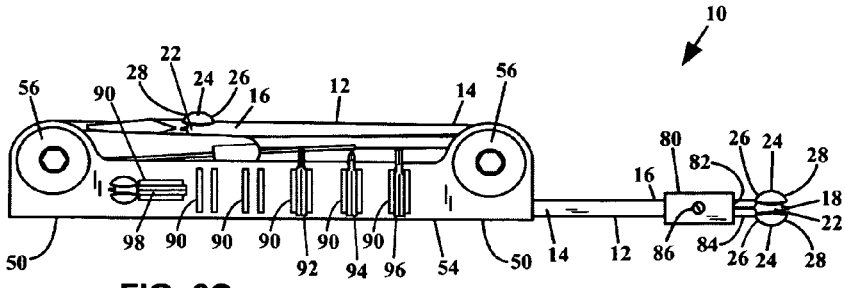
FIG. 6C is a two-dimensional side view of a multi-tool similar to the multi-tool depicted in FIGS. 6A and 6B, wherein a multi-sided shaft of a multi-function tool-tip is shown releasably retained within a socket having the same number of sides which may optionally be employed for releasably retaining any one among an assortment of various tool-tips each having a same multi-sided shaft.
Figure 6D:
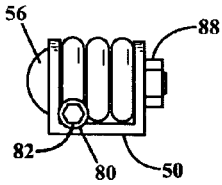
FIG. 6D is a two-dimensional end view of the multi-tool and the multi-sided socket depicted in FIG. 6C.

FIG. 6C depicts a two-dimensional side view of a multi-tool 50 similar to the multi-tool depicted in FIGS. 6A and 6B, wherein a multi-sided shaft 84 of a multi-function tool-tip 22 is depicted releasably retained within a socket 82 having a corresponding number of sides, which may optionally be employed for releasably retaining any one among an assortment of various tool-tips each having a same multi-sided shaft. In FIG. 6C the socket 82 may be integrally formed within an end of tool-shaft 12 (e.g., similar to the socketed end of the tool-shaft depicted in FIG. 4), or alternatively may be formed within an attachable collar, sleeve or adapter 80 which may be secured to a portion of tool-shaft 12 by suitable attaching means (e.g., one or more adapter set screw 86). FIG. 6C depicts the option to equip a handle associated with a tool shaft or an elongated single shaft with multi-function tool tip (e.g., multi-tool handle 54), with one or more retaining means 90 for releasably retaining any one among a plurality of exchangeable tool tips, for example, a hex or Allen key-like tool tip 92, a Phillips screw-driver tool tip 94, a Torx tool tip 96, or a tool tip incorporating a single generally planar member, or a tool tip 98 incorporating two generally planar members and a screw adjustment member 98, and the like. Additionally or alternatively the screw adjustment member portion of tool tip 98 may be configured with a tip incorporating an end of a hex or Allen key, a Phillips screw-driver, a Torx® tool tip, and the like. Additionally or alternatively any one or more of the retaining means 90 may be associated with, and located and/or orientated on the handle in a manner least interfering with the normal clasping of the handle by a user during employment of the handle. For example, the retaining means 90 may be orientated in the manner shown retaining exchangeable tool tips 92, 94 and 96 and/or in the manner shown retaining exchangeable tool tip 98, and so on. Alternatively, tool tip retaining means may include a pouch or other receptacle configurable to be releasably attached to, or be adjoined with a handle, such as multi-tool handle 54. FIG. 6D illustrates a two-dimensional end view of the multi-tool 50 and the multi-sided socket 82 depicted in FIG. 6C.

For the purpose of illustrating a multi-tool particularized for working with various irrigation-related products and/or systems, and made by the applicant of the present patent, FIG. 6A (and to some extent 6B) show rotational tool attaching means 56 on the left end of a multi-tool 50 for rotatably mounting a two size drip tubing punch 58, ⅛" flat screwdriver 60, 3⁄32" hex key, and a 1⁄16" hex key, and rotational tool attaching means 56 on the right end of the multi-tool for rotatably mounting a 3⁄16" flat blade screwdriver 62, a Phillips screwdriver 64 and the aforementioned multi-function tool-tip 22. While the assortment of tools shown mounted on the multi-tool 50 are of a particular combination, it is noted that a multi-function tool 10 of the present invention can easily be rotatably mounted on a multi-tool comprised of one or more different tools, or completely different tools.

It is noted that the applicant of the present patent application has been selling a similarly configured multi-tool called an Irri-Tool™ for many years, however, the T-member-like tool of the Irri-Tool was product-specific (employable on a certain product originally made by one manufacturer), and was not equipped with the multi-function tool-tip 22 described in the present invention which is, in contrast, employable with a variety of products and product-lines made by different or competing manufacturers. Consequently, it has not previously been possible, prior to the conception of the present invention, to commercially produce or make available to the public, a multi-tool incorporating a multi-function tool-tip having the above-described features, benefits and advantages, and at least the elements and aspects previously described, and as detailed in the following sentence.

A handle-operated tool incorporating a multi-function tool tip on a tool shaft or on an elongated tool shaft has been described above, which comprises, elements, features and/or aspects including, but not limited to, the following: a multi-function tool configured to be operable by a handle or grip; a multi-function tool-tip located on at least one end of a shaft member; the multi-function tool-tip comprising a plurality of contours configured for operatively engaging and adjusting rotationally-adjustable members or elements including spray radius or distance adjustment screws and linearly-positionable members or elements of irrigation-related products made by competing manufacturers; the multi-function tool-tip having a single generally planar member extending outwardly from one side, or two generally planar members extending outwardly from opposite sides of the multi-function tool-tip; the tool tip including one or more leading edge contours located proximate or adjacent to a multi-function tool-tip blade transversely disposed on an end of the tool-shaft member, wherein the one or more leading edge contours are configured for facilitating plural axes aligning of the blade within slots of rotationally adjustable screws of irrigation-related products made by competing manufacturers; and, the multi-function tool made of one or more materials suitable for durable use in frequently watered or irrigated environments.

Although the present invention and its advantages have been described in detail, those skilled in the art should understand that they can make various changes, substitutions and alterations herein without departing from the spirit and scope of the invention in its broadest form.

The invention claimed is:

1. A handle-operated tool with a multi-function tool tip, for adjusting and maintaining different irrigation-related products made by one or more manufacturers, the tool comprising:

a single-shaft tool made of a rigid durable material, having configured at a first end a handle, and configured proximate to an opposite, second end of the single-shaft tool a multi-function tool tip comprising two generally planar members each extending outwardly from an opposite side of the single-shaft tool wherein, leading-edge portions of the two generally planar members are sized to fit rotatably within and centeredly align the multi-function tool tip in a plurality of axes when in contact with an annular conical recessed surface of a first irrigation-related product; and wherein trailing-edge portions of the two generally planar members are sized in thickness and width for insertion through an adjustment port of, and for engaging one or more interior portions of, a spring-loaded slidably positionable member of a second irrigation-related product, wherein the shape of the adjustment port is generally round, or round and incorporating opposite, outwardly-extending transverse slot portions;

opposite outer leading-edge portions of the two generally planar members having a tapered or curved contour sized and shaped to facilitate an aligning of the multi-function tool tip end as the leading-edge portions of the planar members (a.) come into contact with the annular conical recessed surface of the first irrigation-related product, or (b.) are being inserted into the adjustment port of the second irrigation-related product;

a screw adjustment member located between opposite leading-edge portions of the two generally planar members of the single-shaft tool, an end of the screw adjustment member sized for engagement within a screw drive located in an upper portion of a screw-head of a rotatable water-spray adjustment screw coaxially located and rotatably operable within the annular conical recessed surface of said first irrigation-related product; and, the opposite trailing-edge portions of the two generally planar members configured to engage one or more interior portions of said spring-loaded slidably-positionable member of the second irrigation-related product, wherein: an insertion of the tool tip through said round and slotted adjustment port of the slidably-positionable member, a rotating of the trailing-edge portions of both planar members out of alignment with the transverse slot portions of the adjustment port, and a pulling of the tool in a direction opposite of the insertion direction, provides selective positioning of the slidably-positionable member.

2. The handle-operated tool with a multi-function tool tip of claim 1 further comprising the tool being made partially or entirely of a durable, rust and water resistant material.

3. The handle-operated tool with a multi-function tool tip of claim 1 further comprising the multi-function tool being made partially or entirely of a stainless steel or stainless tool steel material.

4. The handle-operated tool with a multi-function tool tip of claim 1 further comprising a portion of the multi-function tool being made of a durable plastic or plastic composite material.

5. The handle-operated tool with a multi-function tool tip of claim 1 further comprising a tool handle configured to be securely retained to a portion of said first end of the single-shaft tool wherein said handle is selectable from the group consisting of handles configurable to an end of a single shaft tool.

6. The handle-operated tool with a multi-function tool tip of claim 1 further comprising a tool handle configured to be releasably retained to a portion of said first end of the single-shaft tool.

7. The handle-operated tool with a multi-function tool tip of claim 1 wherein said handle comprises a longitudinally extended multi-tool handle body sufficient in length to facilitate positive gripping by a user's hand, formed integrally, generally U-shaped in cross-section, of rigid water-resistant material;

a first side and a second side of the multi-tool handle body each having a pair of apertures configured to receive a bolt having a threaded end, wherein, in a first pair of apertures each aperture is located proximate to a first end of said first side and said second side, and in a second pair of apertures each aperture is located proximate to a second end of said first side and said second side, such that said first pair of apertures are transversely aliened, and said second pair of apertures are transversely aligned;

a portion of said first end of the single-shaft tool formed into a generally closed loop or mounting aperture sized to transversely receive one of said bolt;

an end portion of each of a plurality of irrigation-product adjustment tools formed into a generally closed loop or mounting aperture, each sized to transversely receive one of said bolt; wherein, said first end of the single-shaft tool, and said end portion of each of a plurality of irrigation-product adjustment tools, are aliened side-by-side interiorly within said generally U-shaped cross-section proximate said first end or said second end of said multi-tool handle and configured pivotably adjustable by one of said bolt mounted transversely through a generally closed loop or mounting aperture of each of; said single-shaft tool and said Plurality of pivotably mounted irrigation-product adjustment tools.

8. The handle-operated tool with a multi-function tool tip of claim 7 wherein, the shaft pivotably securable by a fastener mounted transversely through one or more mounting apertures of said multi-tool handle and through said generally closed loop or mounting aperture, further comprises, a single generally planar member, or both generally planar members of the multi-function tool tip configured, when pivoted to a fully closed position, to align or lie adjacent to one or more other pivotable tools pivoted to a fully closed position, in a manner wherein the single generally planar member, or both generally planar members of the tool-tip are entirely retained within the multi-tool handle.

9. The handle-operated tool with a multi-function tool tip of claim 1 wherein an elongated shaft portion of the single-shaft tool is made of a durable rigid material having a cross-section selectable from among a group of cross-sectional shapes consisting of: cylindrical, oval, elliptical, polygonal, and multi-sided cross-sections.

10. The handle-operated tool with a multi-function tool tip of claim 1 wherein a shaft portion of the single-shaft tool further comprises an arced shaft portion having means for positively engaging an adjustment ring of a sprinkler head nozzle to selectively turn the adjustment ring in a clockwise or counter-clockwise direction as needed.

11. The handle-operated tool with a multi-function tool tip of claim 1 further comprising, a transverse generally 'M' shaped profile incorporated between the two generally planar members, whereby portions of the 'M' shaped profile, when interfacing with an upper end of a water spray adjustment screw coaxially located within said annular conical recessed surface of a sprinkler head nozzle, facilitate plural axes alignment of the multi-function tool tip within the conical recessed surface and an aligning of the tip of the screw adjustment member within a screw drive in the upper end of a water spray adjustment screw.

12. The handle-operated tool with a multi-function tool tip of claim 1 further comprising said screw adjustment member having a length which extends outwardly further than the leading-edge contour of a single generally planar member, or of each of said generally planar members, sized in length, when said multi-function tool tip is seated in said an annular conical recessed surface, to positively engage within said screw drive located in an upper end of the screw-head of the rotatable water-spray adjustment screw.

13. The handle-operated tool with a multi-function tool tip of claim 1 further comprising, said screw adjustment member being integrally formed, or configured releasably retainable at said second end of said single-shaft tool, and having a flat-blade screwdriver-like tip wherein the blade of the screwdriver-like tip is arranged in a 90° orientation to the plane in which a single generally planar member is aligned, or both generally planar members are aligned.

14. The handle-operated tool with a multi-function tool tip of claim 1 further comprising, said screw adjustment member being integrally formed, or configured releasably retainable at said second end of said single-shaft tool, and having a flat-blade screwdriver-like tip wherein the blade of the screwdriver-like tip is arranged in other than a 90° orientation to the plane in which a single generally planar member is aligned, or both generally planar members are aligned.

15. The handle-operated tool with a multi-function tool tip of claim 1 further comprising, at least one end of said single-shaft tool configured with a socket or aperture for releasably retaining any one among a plurality of exchangeable tool tips, a shaft portion of the single-shaft tool.

16. The handle-operated tool with a multi-function tool tip of claim 1 further comprising, said screw adjustment member being integrally formed at, or configured releasably retainable at, said second end of said single-shaft tool, and having a screw adjustment tip engagable within an upper end of a screw head of a water-spray adjustment screw.

17. The handle-operated tool with a multi-function tool tip of claim 16 further comprising, means for releasably retaining one or more of the exchangeable tool tips to a handle of the tool.

18. The handle-operated tool with a multi-function tool tip of claim 1, wherein said handle comprises an extended portion of the single-shaft tool ending at said first end, formed angularly disposed relative to a longitudinal axis of said second end of the single-shaft tool and sized in length to facilitate a gripping by a user's hand sufficient to: (a.) impart a rotational adjustment via one or more portions of said multi-function tool tip made to a water-spray adjustment element of one of said different irrigation-related products: or, (b.) extract to a selective degree a spring-loaded member of one of said different irrigation-related products via at least one of said trailing-edges engaging an interior portion of the spring-loaded member.

19. The handle-operated tool with a multi-function tool tip of claim 1 further comprising, said generally planar members sized and shaped for: insertion through said generally round adjustment port of said spring-loaded slidably-positionable member of said second irrigation-related product, and engagement within an interiorly-located female port configured, in response to receiving rotational adjustment input from said multi-function tool tip made by a user, to provide a corresponding water or water-spray emitting adjustment.

20. A handle-operated tool with a multi-function tool tip, for adjusting and maintaining different irrigation-related products made by one or more manufacturers, comprising:

a single-shaft tool made of a rigid durable material, having configured at a first end a handle, and configured proximate to an opposite, second end of the single-shaft tool, a tool tip end comprising two generally planar members each extending outwardly from an opposite side of the single-shaft tool wherein, leading-edge portions of the two generally planar members are sized to fit rotatably within and centeredly align the multi-function tool tip in a plurality of axes when in contact with an annular conical recessed surface of a first irrigation-related product; and wherein trailing-edge portions of the two generally planar members are sized in thickness and width for insertion through an adjustment port of, and for engaging one or more interior portions of, a spring-loaded slidably positionable member of a second irrigation-related product, wherein the shape of the adjustment port is generally round, or round and incorporating a transverse slot;

opposite outer leading-edge portions of the two planar members having a tapered or curved contour sized and shaped to facilitate an aligning of the multi-function tool tip end as the leading-edge portions of the planar members (a.) come into contact with the annular conical recessed surface of the first irrigation-related product, or (b.) are being inserted into the adjustment port of the second irrigation-related product;

a water-spray adjustment blade transversely disposed at the end of the tool tip between, and aligned with, opposite leading edge portions of both planar members, a central leading-edge portion of the water-spray adjustment blade sized and shaped for engagement within a slot of an upper portion of a screw head of a rotatable water-spray adjustment screw coaxially located and rotatably operable within the annular conical recessed surface of said first irrigation-related product; and, at least one planar member equipped with a trailing-edge portion configured to engage one or more interior portions of said spring-loaded slidably-positionable member of the second irrigation-related product, wherein: an insertion of the tool tip through said round and slotted adjustment port of the slidably-positionable member, a rotating of the trailing-edge portions of both planar members out of alignment with the slotted transverse slot portions of the adjustment port, and a pulling of the tool in a direction opposite of the insertion direction, provides selective positioning of the slidably-positionable member.

21. A handle-operated tool with a multi-function tool tip, for adjusting and maintaining different irrigation-related products made by one or more manufacturers, comprising:

a single-shaft tool made of a rigid durable material, having configured at a first end a handle, and configured proximate to an opposite, second end of the single-shaft tool, a multi-function tool tip end having at least one generally planar member extending outwardly from a side of the tool shaft wherein, a leading-edge portion of the at least one planar member is sized to fit rotatably within an annular conical recessed surface of a first irrigation-related product, and sized to fit through an adjustment port of a spring-loaded slidably-positionable member of a second irrigation-related product, wherein the shape of the adjustment port is generally round, or round and incorporating opposite, outwardly-extending transverse slot portions;

an outer leading-edge portion of the at least one generally planar member having a tapered or curved contour to facilitate an aligning of the tool tip end as the leading-edge portion of the at least one planar member (a.) comes into contact with the first irrigation-related product, or (b.) is being inserted into the adjustment port of the second irrigation-related product;

a screw adjustment member located adjacent said second end of the single-shaft tool and a tool-shaft adjacent portion of said at least one leading edge portion of said at least one generally planar member, an end of the screw adjustment member sized for engagement within a screw drive located in an upper portion of a screw-head of a rotatable water-spray adjustment screw coaxially located and rotatably operable within the annular conical recessed surface of said first irrigation-related product; and, an opposite trailing-edge portion of said at least one generally planar member configured to engage an interior portion of said spring-loaded slidably-positionable member of the second irrigation-related product, wherein: an insertion of the tool tip through said round and slotted adjustment port of the slidably-positionable member, a rotating of the trailing-edge portion of said at least one generally planar member out of alignment with the transverse slot portions of the adjustment port, and a pulling of the tool in a direction opposite of the insertion direction, provides selective positioning of the slidably-positionable member.

* * * * *